United States Patent [19]

Goldhammer et al.

[11] Patent Number: 4,889,291

[45] Date of Patent: Dec. 26, 1989

[54] STRIP-OFF DEVICE FOR SHEDDING MACHINES WITH SHEET MATERIAL GRID ENGAGING BETWEEN SHREDDING DISKS

[75] Inventors: Albert Goldhammer, Ueberlingen; Hans Schleicher, Markdorf; Hartmut Stangenberg, Owingen; Rolf Gasteier, Markdorf, all of Fed. Rep. of Germany

[73] Assignee: Feinwerktechnik Schleicher & Co., Fed. Rep. of Germany

[21] Appl. No.: 164,222

[22] Filed: Mar. 4, 1988

[51] Int. Cl.[4] ..... B02C 18/22

[52] U.S. Cl. ..... 241/167; 241/236

[58] Field of Search ..... 241/236, 235, 166, 167

[56] References Cited

U.S. PATENT DOCUMENTS 2,547,234 4/1951 Spang ..... 241/236 X

FOREIGN PATENT DOCUMENTS 3616554 11/1987 Fed. Rep. of Germany ..... 241/236

*Primary Examiner*—Mark Rosenbaum

*Attorney, Agent, or Firm*—Steele, Gould & Fried

[57] ABSTRACT

The cutting tool (3) formed by two cutter blocks (7) of a shredding machine has a stripping means with two stripping grids (10) located between the cutter blocks (7) and two stripping plates (11) located outside the cutting zone and which in each case engage in the gaps (9) between the cutting disks (8) of the cutter blocks (7). The stripping plate (11) associated with each cutter block (7) by one-piece construction is constructionally combined with the associated stripping grid (10), so that there is a very precise alignment of the stripping plate (11) with respect to the stripping grid (10) and all the stripping plates (11) and all the stripping grids (10) can be secured with common supporting plates (30).

21 Claims, 2 Drawing Sheets

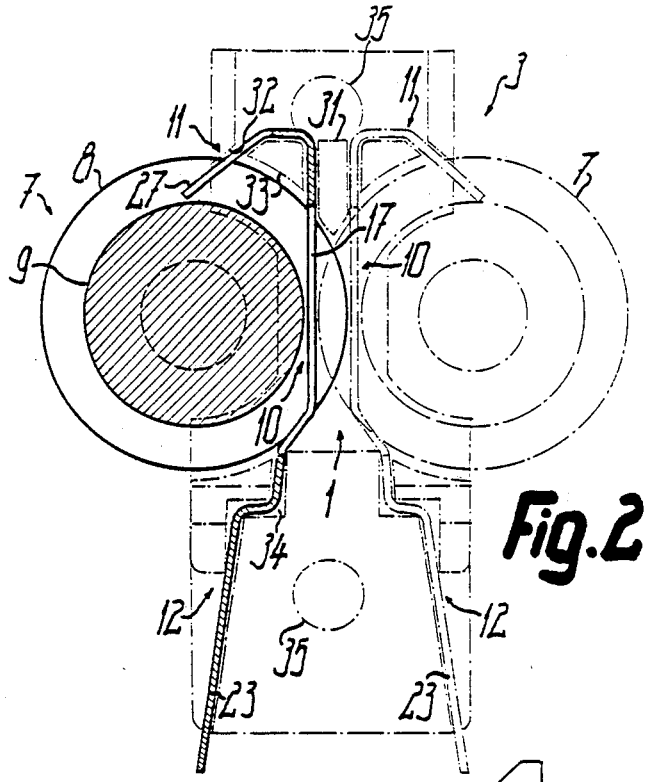
Fig.2
Fig.3
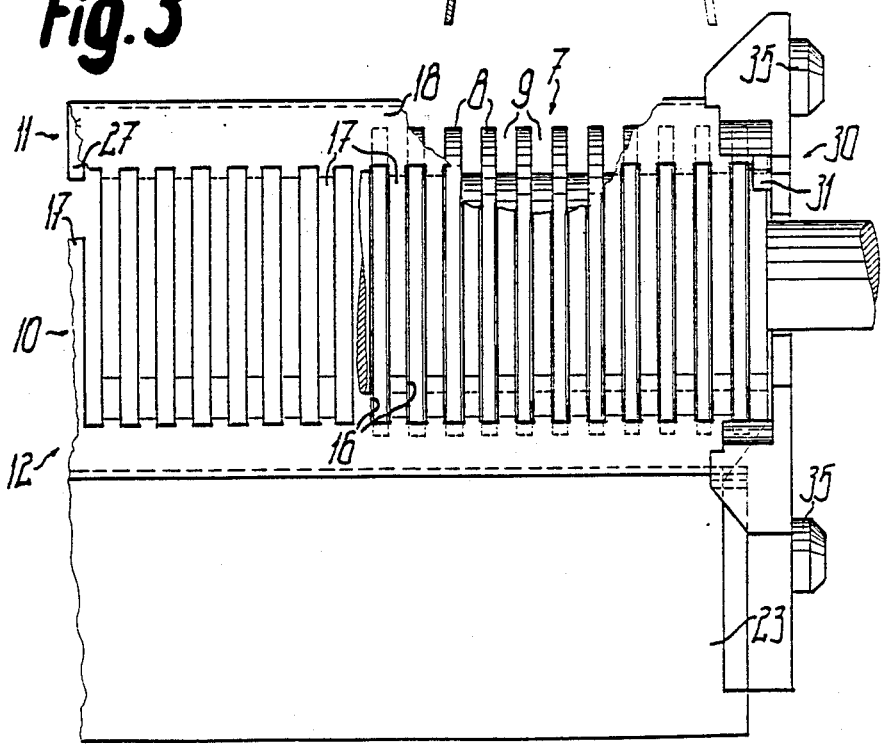

STRIP-OFF DEVICE FOR SHEDDING MACHINES WITH SHEET MATERIAL GRID ENGAGING BETWEEN SHREDDING DISKS

BACKGROUND OF THE INVENTION

1. Field of the Invention

The invention relates to a cutter block or roller stripping means for shredding machines or the like, in particular the invention has stripping webs formed by a sheet metal or similar stripping grid for engaging between the cutting disks of the particular cutter block in the cutting zone thereof associated with an opposed other cutter block stripping tongues are formed by a sheet metal or similar stripping comb or plate for engaging between the cutting disks outside the cutting zone.

2. Prior Art

In such stripping means, the stripping webs engaging in the gaps between all the cutting disks mostly form diverters or restrainers for the material to be comminuted, so that the material cannot be deposited too deeply between the cutting disks. Any comminution material which is still deposited in these gaps is then removed outside the cutting zones in scraping manner by the stripping tongues and is led out of the gaps, so that during further rotation of the disks the material cannot get behind the stripping webs and thereby excessively deform or even permanently bulge the same. In the hitherto known stripping means, the stripping plate is arranged on a solid supporting rod, which is arranged with terminal threaded pins in mounting supports of the shredding machine, said supports being completely separate from those of the stripping grid. Thus, the position of the stripping plate with respect to the associated cutter block and therefore with respect to the associated stripping grid must be fixed by adjustment, which can easily lead to errors, so that e.g. the ends of the stripping tongues do not reliably engage in resilient and therefore scraping manner on the lower-lying circumferential surfaces forming the bottoms of the gaps between the disks. Moreover, the known construction also leads to increased assembly expenditure, which can in particular be disadvantageous during the maintenance or cleaning of the cutting tool of the shredding machine or the like.

SUMMARY OF THE INVENTION

An object of the present invention is to provide a cutter block stripping means of the aforementioned type which, in case of simple construction, ensures a precise preadjustment of the stripping plate with respect to the stripping grid and therefore with respect to the cutter block to be engaged therewith.

This object is achieved in a surprisingly simple manner in the case of a cutter block stripping means of the aforementioned type, in that the stripping plate is arranged on the stripping grid. Thus, the stripping plate and the stripping grid form a prefabricated, closed constructional unit, in which the stripping tongues and stripping webs are precisely adjusted with respect to one another and which can be mounted as an entity in the shredding machine or the like.

It is admittedly conceivable to provide on the stripping plate separate retaining members for the fixing thereof in the shredding machine and more especially on the casing thereof, but a particularly advantageous construction is obtained if the stripping plate is substantially exclusively secured by its connection with the stripping grid, so that there is no need for separate holding devices for the stripping plate.

Furthermore, the stripping plate can be formed by a separate component with respect to the stripping grid, which is either adjustable and can e.g. be fixed or firmly seated with clamping screws, e.g. by spot welding to the stripping grid. However, an extremely simple preadjustment, compact dimensions and favorable resilience and strength characteristics are achieved if the stripping plate is constructed in one piece with the stripping grid. Thus, the stripping plate and the stripping grid can be formed by a single stamped bent part, which in a single operation can be manufactured in dimensionally accurate and therefore also precisely adjusted manner. This component can then be very simply fitted and removed again as an entity.

It is particularly advantageous if the stripping plate is provided on one longitudinal edge of the stripping grid, preferably on its upper longitudinal edge, so that on the one hand the stripping tongues are located in the upper area or on the top of the cutter block and on the other hand the lower longitudinal edge of the stripping grid remains free for forming an ejection shaft for the comminuted material.

Furthermore, as a result of the last-described construction in order to obtain a harder resilience, the stripping plate can be supported on a filling shaft and in particular on the end face of said filling shaft for the material to be comminuted. This can e.g. be achieved without special constructional expenditure in that the stripping plate passes via a transverse web into the stripping grid, which preferably forms a stop shoulder for the inner end of the filling shaft of the casing of the cutter block or shredding machine. If the transverse web is not directly supported, as a result of the angle section formed by it, it still leads to significant increase in the strength of the stripping plate and the stripping grid, which merely require a single common transverse web for said reinforcement.

Both for obtaining a favorable setting angle of the stripping tongues and also for a space-saving construction with favorable resilience characteristics, the stripping plate is cross-sectionally more particularly bent to an angle of approximately 45°. The stripping tongues preferably form one complete angle leg and extend via the bent zone approximately into the other angle leg formed in the previously described embodiment by the transverse web. This angle leg or transverse web remote from the stripping tongue ends is, according to a further development of the invention, much shorter than the stripping tongues and is in particular at the most half as long, whereby it appropriately passes approximately at right angles into the stripping grid and therefore forms a closure between the stripping grid and the stripping tongues.

Particularly if the stripping tongues are arranged on the inlet side of the cutter blocks, a particularly favorable setting angle is obtained with respect to the cutter blocks, if the stripping tongues are located towards the cut material passage direction under an acute angle of preferably approximately 45° opening in the passage direction. If the stripping tongues were provided in the vicinity of the outlet side of the cutter block, said angle would appropriately open in the opposite direction.

A particularly simple embodiment of the invention comprises providing two hamologously arranged and preferably identical stripping plates for the two cutter blocks which are constructionally combined with the associated stripping grid.

According to a further inventive feature, for securing the stripping plate the particular end of the stripping plate is connected to an in particular slipped on support plate, which is preferably provided jointly for both associated ends of the two stripping plates and it is not necessary as a result of the self-supporting characteristics of said stripping plate for the two support plates to be interconnected over the entire length of the stripping plate.

For securing the stripping plate already securely held by its connection to the stripping grid, it is sufficient if the support plate has in each case a slot-like receptacle for the associated end of the stripping plate, so that the latter, including the stripping grid are merely connected to the support plates by slipping on and can then be readily installed in the casing, e.g. also by slipping in.

These and further features of the preferred further developments of the invention can be gathered from the description and drawings and the individual features can be realized in any embodiment of the invention and in other fields either alone, or in the form of subcombinations.

BRIEF DESCRIPTION OF THE DRAWINGS

Embodiments of the invention are described hereinafter relative to the drawings, wherein:

FIG. 2 shows the shredding machine cutting tool according to FIG. 1 in a longitudinal view.

FIG. 3 is a detail of FIG. 2 in a view from the right.

DETAILED DESCRIPTION OF THE PREFERRED EMBODIMENTS

Figure 1:
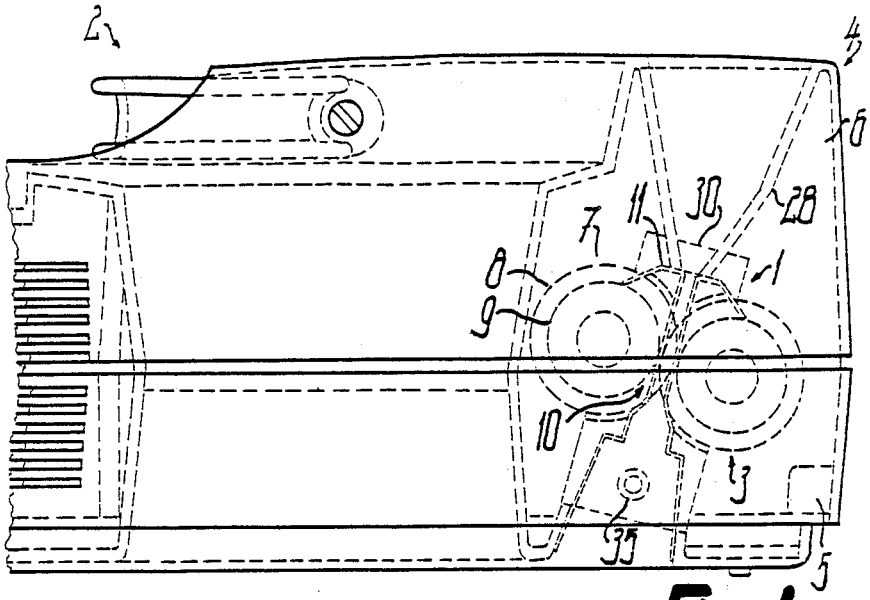
FIG. 1 is a detail of a shredding machine provided with an inventive cutter block stripping means in side view and in simplified form.

The cutter block stripping means 1 shown in FIGS. 1 to 4 is associated with the cutting tool 3 of a shredding machine 2 and is arranged with said cutting tool 3 within a casing 4 comprising the casing base 5 and the casing top 6 and namely in the rear region thereof. Cutting tool 3 has two axially parallel, almost meshing horizontal cutter blocks 7, whereof each carries a plurality of spaced, juxtaposed, cylindrical cutting disks 8, the gaps 9 between adjacent cutting disks 8 having cylindrical bottom surfaces and are approximately of the same width as the cutting disks, so that the cutting disks 8 of the in each case facing cutter blocks 7 engage in almost clearance-free manner and approximately over the full depth in gaps 9.

In addition, relatively thin and e.g. max 1 mm thick stripping webs of a stripping grid 10 also engage in the gaps 9 of each cutter block 7 in such a way that the linear, engaging portion is approximately at right angles to the common axial plane of the two cutter blocks 7 and is located on one side tangentially on the bottom surface of the associated gap 9 and on the other side on the circumferential surface of the facing cutter block 8 engaging in said gap 9. The parallel, facing webs of the stripping grid 10 are consequently at a spacing from one another which is smaller by their common thickness than the inside spacing between the bottom surfaces of gaps 9 of the facing cutter blocks 7, the webs forming a narrow passage shaft with a width corresponding to said spacing. In the vicinity of the top of each cutter block 7 is additionally provided a stripping plate 11 which, outside the cutting zone where the two cutter blocks 7 interengage, engages in the gaps 9 of the in each case associated cutter block 7 and optionally engages in scraping manner on the bottom surfaces and/or lateral surfaces of said gaps 9.

Figure 4:
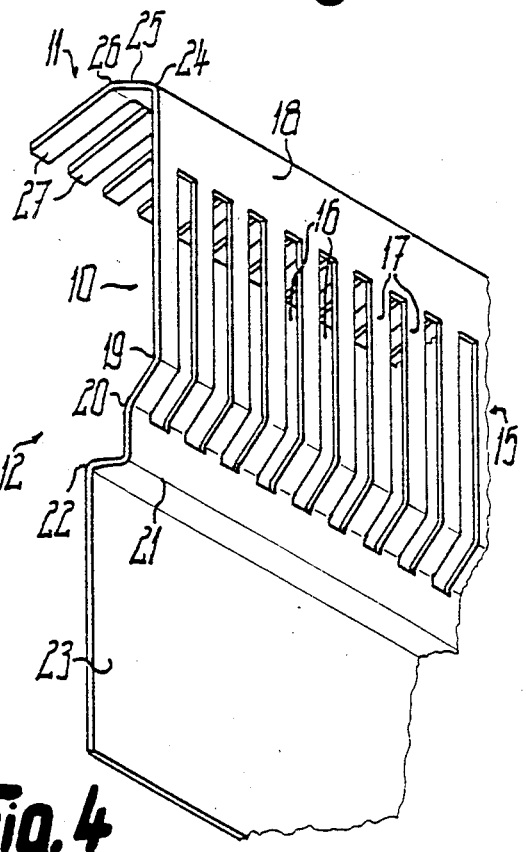
FIG. 4 is a detail of the stripping member of the cutting tool according to FIG. 2 in a perspective view.

As shown in FIG. 4 the stripping grid 10 and the stripping plate 11 are formed by a single, sheet metal, one-piece stripping body 12. Stripping grid 10 has a main portion 15 representing approximately a third of the total height of stripping body 12 forming the grid and in which are provided juxtaposed, identical slots 16 and between them the approximately equally wide stripping webs 17, which are located in a common plane in their zone associated with the intake side and passing over most of their length. Cutting disks 8 engage through the window slots 16, whilst the stripping webs are located in gaps 9. Towards the intake side, to the main portion 15 is connected an opening-free portion 18, whose height is significantly smaller than the length of slots 16, so that the terminal limitations of slots 16 located in said portion 18 are immediately adjacent to the outer circumference of cutting disks 8. Spaced from the other end of the window slots 16 or stripping webs 17, main portion 15 passes via a first bend 19 into a portion of equal height inclined outwards by an angle of approximately 45° and which over a further opposite bend 20 passes into an opening-free portion having approximately the same height and width as it and which is appropriately approximately plane-parallel to the main portion 15. The associated terminal limitations of the window slots 16 are located approximately in said second bend 20, but appropriately extend slightly beyond the same, in such a way that also these terminal limitations are immediately adjacent to the outer circumference of the cutting disks. The later opening-free portion passes via a further bend 21 directed outwards approximately at right angles into a narrow shoulder strip, which in turn passes via an approximately right-angled bend 22 directed away from the stripping plate 11 into an end portion 23, which is of approximately the same height as main portion 15. The opening-free end portion 23 forms one longitudinal boundary of the outlet shaft of cutting tool 3 which is wider than the cutting shaft and which is connected to an outlet opening on the underside of casing 4 or the casing base 5.

The opening-free portion 18 passes via a bend 24 passing outwards approximately at right angles into a transverse web 25 of stripping plate 11 from which juxtaposed stripping tongues 27 in the same pattern as the stripping webs 11 slope outwards and project into the gaps 9 of the associated cutter block 8 in such a way that their terminal edges engage under a negative scraping angle on the bottom surfaces of gaps 9. The stripping tongues 27 also pass out from a bend 26 bounding the cross-section 25 on its associated outside and which is at an angle of approximately 135° to the transverse web 25, the comb or plate slots between the stripping tongues 27 extending slightly beyond the bend 26 into the transverse web 25. By means of transverse web 25, stripping body 12 can engage on the associated longitudinal boundary located in casing 4 on the inner end of a filling shaft 28, which is open at the top of the casing top part 6 and tapers in funnel-shaped manner towards the cutting tool 3 approximately to the width of the cutting shaft. Thus, the stripping tongues 27 can be even better supported against the scraping pressure acting thereon. In order to bring about an even better alignment of the associated ends of the stripping body 12 with respect to the filling shaft, it is also possible to provide webs or other projections on the tops of the stripping plates 11, which webs or other projections, on the outsides of the walls of filling shaft 28, engage over the length thereof and which can be formed by separate parts, e.g. by angle sections fixed by spot welding.

Figure 5:
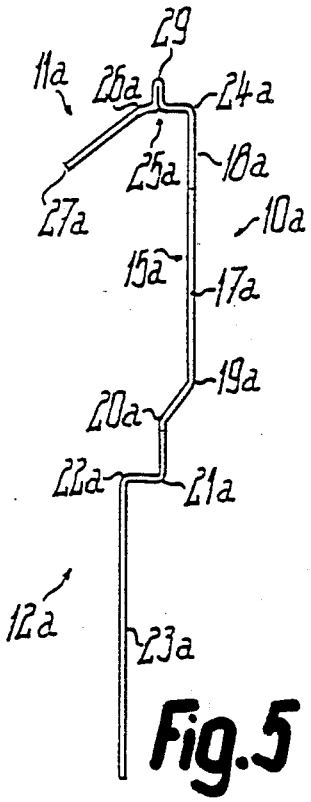

According to FIG. 5, in which corresponding parts are given the same reference numerals as in FIG. 4, but accompanied by the letter "a", shows an embodiment for such a web projection 29, which is constructed in one piece with the stripping plate 11 and therefore with the stripping body 12. The web projection 12 is formed by a zone shaped out of the transverse web **25*a* by a double layer and in the represented embodiment is located between bends 24*a* and 26*a*, so that a type of angle section is formed for the engagement on the associated wall of filling shaft 28. However, the web projection 29 can also be located in the vicinity of bend 26*a*, which is then formed by an oppositely directed bend in such a way that the stripping tongues 27*a*, under their setting angle are directly connected to the foot of the web projection 29 and therefore in their longitudinal direction are supported almost at right angles directly with respect to the associated wall of filling shaft 28**.

FIG. 2 shows a support plate 30 for holding the stripping body 12 in corresponding counter-supports of the casing base 5 in dot-dash line manner. Also the right-hand cutter block 7 and the right-hand stripping body 12 are indicated in dot-dash form. FIG. 3 is a side view as compared to FIG. 2, from the right-hand cutter block and the right-hand stripping body, the supporting plate 30 being shown in continuous line form. For the two ends of both stripping bodies 12 located at one end of the cutter block 7 is provided a single common supporting plate 30 extending on one side outwards beyond the transverse webs 25 and on the other side covering the end portions 23. For the positional alignment of the stripping plates 11, the supporting plate 30 has a web-like spacing member 31 engaging between portions 18, as well as, also on its inside, a slot-like receptacle 32, in which engages the associated terminal stripping tongue 27 with an area located between its ends. On the inside of the approximately U-shaped section formed by portion 18, transverse web 25 and stripping tongues 27, there is also a support projection 33 projecting over the inside of the supporting plate and which with the spacing member 31 on the one hand forms a slot-like receptacle for portion 18 and on the other hand defines the slot-like receptacle 32 on the associated side. This leads to an extremely simple and precise alignment of the particular stripping plate 11. In the area between bend 20 or the associated ends of the stripping webs 17 and end portion 23, supporting plate 30 has further, angular slot-like receptacles 34 for holding the associated portions of stripping body 12 by insertion in the longitudinal direction thereof, said receptacles also assisting the alignment of the stripping plates 11. Each supporting plate 30 is provided on the outside with self-closure members in the form of two superimposed pin projections 35 for inserting in the counter-support of the cutting tool 3. The upper pin projection 35 is level or slightly above the stripping plates 11, so that the stripping bodies 12 are very precisely positionally secured in this area. The other pin projection 35 is located on the other side of cutter block 7.

We claim:

1. A strip-off device for shredding machines having shredding disks on at least one shredding roller, said device comprising:

at least one strip-off unit;

at least one strip-off grid defined by said at least one strip-off unit, strip-off webs of said strip-off grid being engageable between said shredding disks;

at least one strip-off comb defined by said at least one strip-off unit, strip-off tongues of said strip-off comb being engageable between said shredding disks substantially at a circumferential distance around the shredding disks relative to said strip-off webs;

supporting profiles bearing said strip-off webs and said strip-off tongues, said supporting profiles being mountable on said shredding machine, and wherein at least one of said supporting profiles for said strip-off comb is a sheet material profile providing said strip-off tongues, at least one said sheet material profile connecting said strip-off comb to said strip-off grid, thereby providing a connecting profile.

2. The strip-off device according to claim 1, wherein the at least one said sheet material profile is constructed in one piece with at least one of two units formed by the strip-off webs and the strip-off tongues.

3. The strip-off device according to claim 1, wherein the at least one said sheet material profile is constructed in one piece with at least one of two units formed by the strip-off grid and the strip-off comb.

4. The strip-off device according of claim 1, wherein the strip-off grid and the strip-off comb are constructed in one piece.

5. The strip-off device according to claim 1, wherein said strip-off webs provide groups of comb-adjacent and comb-remote ends, said ends of each of said groups being interconnected by at least one said sheet material profile, thereby providing window-slots having end edges located directly adjacent to outer circumferences defined by said shredding disks.

6. The strip-off device according to claim 5, wherein said comb-adjacent ends of said strip-off webs continue into a connecting portion passing via a bend into a transverse web of said strip-off comb, said connecting portion and said transverse web forming said connecting profile.

7. The strip-off device according to claim 6, wherein said transverse web has a width substantially smaller than a length extension of said strip-off tongues, said transverse web being located substantially at a right angle to said strip-off grid.

8. The strip-off device according to claim 1, wherein said connecting profile has two bends, one of said two bends being a bend of said strip-off grid, said strip-off tongues freely projecting from a vicinity of another of said two bends.

9. The strip-off device according to claim 1, wherein said strip-off tongues have terminal scraping end edges positively projecting against bottom surfaces of gaps between said shredding disks.

10. The strip-off device according to claim 1, wherein said strip-off comb is outwardly bent at an angle of substantially 45° with respect to said strip-off grid.

11. The strip-off device according to claim 1, wherein said at least one shredding roller provides a shredding gap determining a gap plane and an advance direction from an inlet side to an outlet side, said strip-off tongues projecting with terminal scraping end edges at an acute angle with respect to said gap plane, said acute angle opening in said advance direction.

12. The strip-off device according to claim 1, wherein terminal scraping end edges of said strip-off tongues are located in the vicinity of an upmost zone of the device, an inlet side of a shredding gap defined by said at least one shredding roller being located in the vicinity of an upper side of said shredding roller providing said upmost zone.

13. The strip-off device according to claim 1, wherein an inlet shadt is defined at an inlet side of a shredding gap provided by said at least one shredding roller, a transverse web of said connecting profile forming a connecting shoulder for said inlet shaft.

14. The strip-off device according to claim 1, comprising two substantially equal strip-off units, each having one of said connecting profiles and each being made of sheet material, the strip-off units being engageble with each of two interengaging shredding rollers, said two strip-off units being located in substantially mirror-symmetrical orientation.

15. The strip-off device according to claim 1, wherein said strip-off unit, forming said strip-off grid and said strip-off comb, is entirely made of sheet metal.

16. The strip-off device according to claim 1, wherein each of two spaced supporting profiles of at least one said strip-off unit has two remote ends on lateral sides of the strip-off unit, and further comprising lateral bearing members commonly supportingly engaging into said ends of at least one said strip-off unit on each lateral side.

17. The strip-off device according to claim 16, wherein said bearing member on an inner side thereof has at least one of means provided by bearing slots and bearing projections, for engaging into said ends of said supporting profiles.

18. The strip-off device according to claim 16, wherein said lateral bearing members are provided for engagement with said supporting profiles are by insetion in a length direction of said supporting profiles.

19. The strip-off device according to claim 16, wherein said bearing members have spacer portions for engaging between opposite strip-off units at least in the vicinity of two connect profiles of said opposite strip-off units.

20. The strip-off device according to claim 16, wherein said strip-off comb defines lateral outmost strip-off tongues, said bearing members being provided for supportingly engaging into said outmost strip-off tongues.

21. The strip-off device according to claim 16, wherein an outer side of at least one of said bearing members provides attachment members for engagement into counter-supports of the shredding machine, one of said attachment members being located in the vicinity of the strip-off comb.

* * * * *

UNITED STATES PATENT AND TRADEMARK OFFICE

CERTIFICATE OF CORRECTION

PATENT NO. : 4,889,291

DATED : December 26, 1989

INVENTOR(S) : Goldhammer et al.

It is certified that error appears in the above-identified patent and that said Letters Patent is hereby corrected as shown below:

On the title page, item [54] and in column 1, line 2, in the title of the invention delete "SHEDDING" and insert --SHREDDING--.

Column 2, line 67, delete "hamologously" and insert --homologously--.

Column 3, line 37, insert --Fig 5. shows another embodiment of a stripping body in cross-section--.

Column 4, line 17, delete "whilst" and insert --while--.

Column 4, line 36, delete "later" and insert --latter--.

Column 5, line 32, after "the", insert --right without the--.

UNITED STATES PATENT AND TRADEMARK OFFICE
CERTIFICATE OF CORRECTION

PATENT NO. : 4,889,291

DATED : December 26, 1989

INVENTOR(S) : Goldhammer et al.

It is certified that error appears in the above-identified patent and that said Letters Patent is hereby corrected as shown below:

In claim 13, column 7, line 11, delete "shadt" and insert --shaft--.

In claim 18, column 8, line 11, delete "are", after "profiles" and before "by".

In claim 18, line 11, delete "insetion" and insert --insertion--.

In claim 19, column 8, line 16, delete "connect" and insert --connecting--.

Signed and Sealed this

Sixteenth Day of April, 1991

*Attest:*

*Attesting Officer*

HARRY F. MANBECK, JR.

*Commissioner of Patents and Trademarks*